United States Patent [19]

Frame

[11] Patent Number: 4,494,429

[45] Date of Patent: Jan. 22, 1985

[54] CROSSCUT SAW CARRIAGE

[76] Inventor: Warren C. Frame, Box W, Ronan, Mont. 59864

[21] Appl. No.: 450,654

[22] Filed: Dec. 17, 1982

[51] Int. Cl.[3] ..... B27B 27/06

[52] U.S. Cl. ..... 83/435.1; 83/437; 83/477.2

[58] Field of Search ..... 83/477.2, 435.1, 437, 83/421, 418

[56] References Cited

U.S. PATENT DOCUMENTS

| | | | |
|---|---|---|---|
| 357,133 | 2/1887 | Rudolph | 83/435.1 |
| 901,699 | 10/1908 | Fetzer | 83/435.1 |
| 1,092,518 | 4/1914 | Brooks | 83/437 |
| 1,225,545 | 5/1917 | Whitaker | 83/435.1 |
| 1,575,200 | 3/1926 | Fredenburg | 83/435.1 |
| 2,237,556 | 4/1941 | Hedgpeth . | |
| 2,966,177 | 12/1960 | Weiskopf . | |
| 4,248,115 | 2/1981 | Brodbeck et al. | 83/435.1 |
| 4,259,887 | 4/1981 | Dean | 83/437 |

*Primary Examiner*—Donald R. Schran

*Attorney, Agent, or Firm*—Wells, St. John & Roberts

[57] ABSTRACT

Shown is a crosscut saw carriage for use on table and other crosscut saws. The saw carriage includes a transverse beam which supports a workpiece over a substantial length so that more accurate positioning of the workpiece can be maintained. A rolling carrier supports the transverse beam at the edge of the saw table allowing the saw carriage to be advanced and retracted to or from the saw blade in very easy and smooth motions. One embodiment of the invention includes an adjustable linkage which allows the transverse beam to be oriented at oblique angles to the saw blade. The saw carriage is connected to the miter guide which is a usual part of most table or other crosscut saws.

1 Claim, 5 Drawing Figures

FIG 3
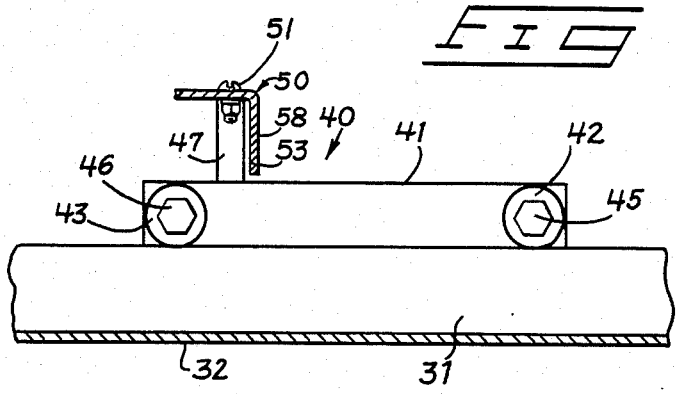
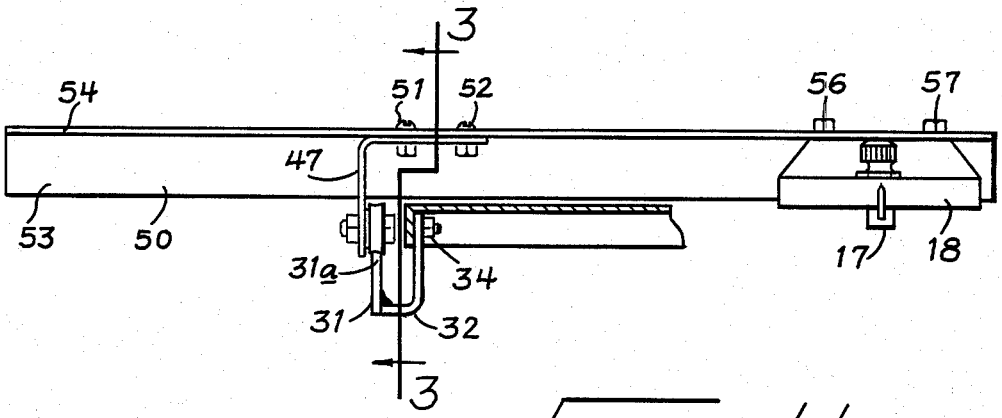
FIG 4
FIG 5
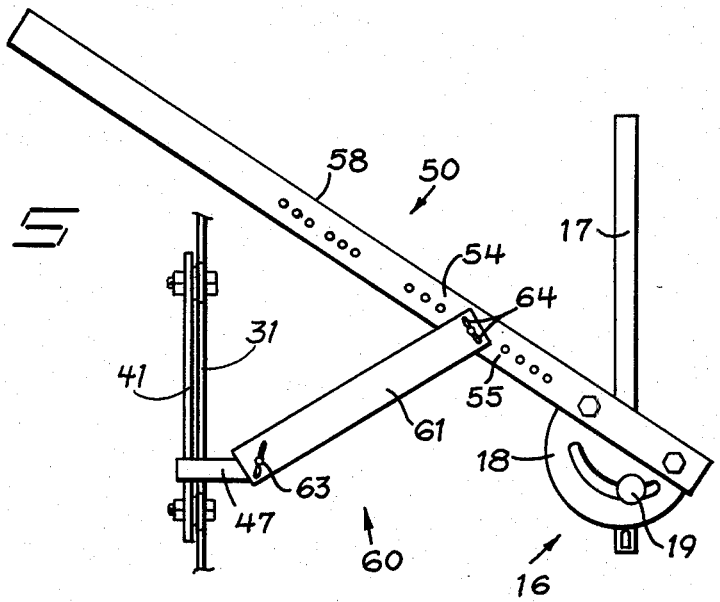

CROSSCUT SAW CARRIAGE

TECHNICAL FIELD OF THE INVENTION

The technical field of this invention is carriages for use with crosscut saws such as a table saw.

BACKGROUND OF THE INVENTION

Table saws are commonly used to cut transversely across a piece of lumber or other material which is being sawn. Most table saws have a miter guide which helps the sawyer to orient the piece of material at an appropriate angle with respect to the saw blade. These miter guides are typically adjustable so that material can be cross cut through a wide range of angles including perpendicular.

The miter guide commonly available on table saws is usually about eight inches in width. When pieces of lumber are substantially longer than this, there is a good chance that the actual saw cut will not be at the desired angle because of misalignment between the piece of lumber and the miter guide. It is also common for the miter guides to include a long guide rail which fits in a slot formed in the surface of the saw table and is slidable to and from the saw blade. Such slidable guide rails often are difficult to slide because dirt and other debris may enter into the slot and cause the rail to bind. It is also common for the rails to develop rust which impedes the easy sliding of the miter guide.

Although the miter guides described above are commonly used on table saws, they are also occasionally used on other types of crosscut saws. Miter guides incorporated into these other types of crosscut saws similarly suffer from the limitations of lack of support for the piece of lumber and difficulty in sliding the miter guide with ease and smoothness. Such smooth and easy operation of the miter guide is necessary for precision work.

The current invention was developed with the above problems and limitations of the prior art in mind. The invention solves these problems and other problems using the structure and function of the invention described below.

BRIEF DESCRIPTION OF THE DRAWINGS

A preferred and alternate embodiment of this invention is illustrated in the accompanying drawings, in which:

FIG. 3 is a partial side view of the crosscut saw carriage shown in FIG. 2, portions of the saw have been removed for clarity of presentation;

FIG. 4 is a front end view of the crosscut saw carriage of FIG. 1, portions of the saw have been removed for clarity of presentation; and FIG. 5 is a top view of an alternative embodiment of the invention having an adjustable transverse beam.

DESCRIPTION OF THE PREFERRED EMBODIMENT

In compliance with the constitutional purpose of the Patent Laws "to promote the progress of science and useful arts" (Article 1, Section 8), applicant submits the following disclosure of the invention.

Figure 1:
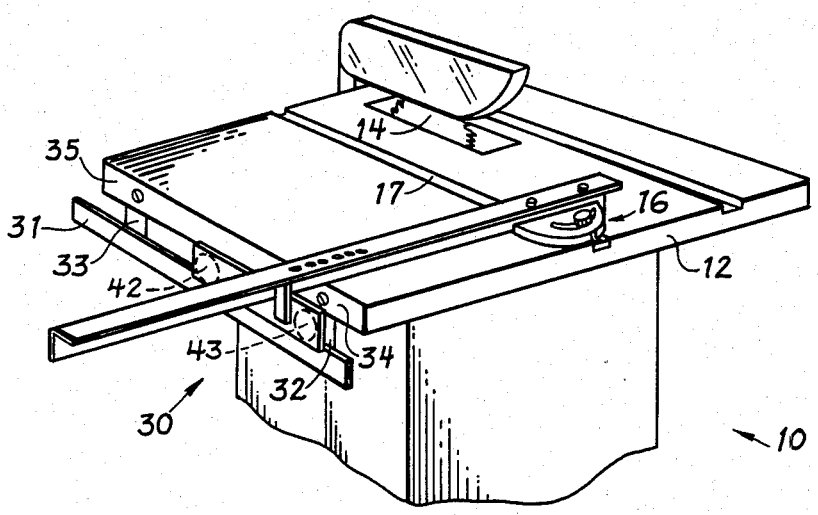
FIG. 1 is a perspective view of a table saw fitted with a crosscut saw carriage according to this invention.

FIG. 1 shows a table saw generally referred to by the reference numeral 10 which has been fitted with an embodiment of the crosscut saw carriage of this invention. Table saw 10 has a saw table 12, saw blade 14 and miter guide 16. Miter guide 16 includes a guide bar 17 and a miter guide head 18. Miter guide head 18 is usually rotatable with respect to the guide bar 17 so that pieces of lumber or other material can be cut at oblique angles.

The crosscut saw carriage 30 of this invention is preferably attached to the miter guide 16 and to saw table 12. Crosscut saw carriage 30 includes a rail 31 which is attached to the saw table 12, using angle brackets 32 and 33 and fasteners 34 and 35. Rail 31 is preferably welded to angle brackets 32 and 33 and is approximately vertical.

Crosscut saw carriage 30 also includes a rolling carrier 40 which rolls upon rail 31. Rolling carrier 40 includes a carrier bar 41 and rollers 42 and 43. Rollers 42 and 43 are mounted to carrier bar 41 using fasteners 45 and 46. Bracket 47 connects rolling carrier 40 to the transverse beam 50 using fasteners 51 and 52.

Figure 2:
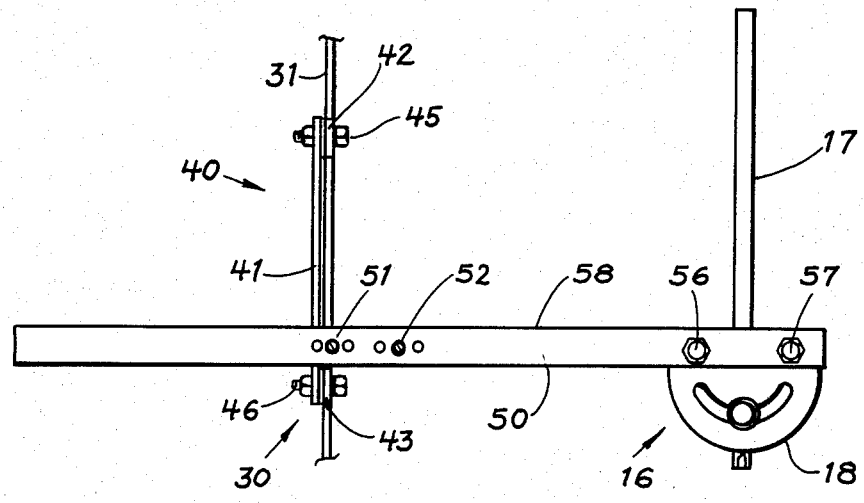
FIG. 2 is a top view of the crosscut saw carriage shown in FIG. 1, portions of the saw have been removed for clarity of presentation.

Transverse beam 50 is preferably an elongated piece of metal having an angular cross-sectional shape. The first leg 53 of transverse beam 50 is substantially vertical. The second leg 54 of transverse beam 50 is substantially horizontal and lies along the upper surface of the miter guide 16. Transverse beam 50 is preferably bolted to miter guide head 18 using fasteners 56 and 57 which pass through apertures in the second leg 54 of transverse beam 50. Transverse beam 50 should preferably be connected to miter guide head 18 so that the outer face 58 of the first leg of the transverse beam is parallel to the normally exposed face of the miter guide head 18. In the case of the embodiment shown in FIG. 2, outer face 58 would be perpendicular to the saw blade 14. Material cut using the crosscut saw guide of FIG. 2 would have an end which is perpendicular to the side of the material which abutted outer face 58.

Crosscut saw carriage 30 is used by first installing rolling carrier 40 upon rail 31 by placing rollers 42 and 43 along the upper edge **31*a* of rail 31. Transverse beam 50 is then connected to the miter guide head 18 using fasteners 56 and 57. Transverse beam 50 is adjusted before tightening fasteners 56 and 57 so that the outer face 58 is perpendicular to the saw blade 14 and also perpendicular to the direction of travel of crosscut saw carriage 30. The piece of lumber is then placed upon the saw table 12 and saw carriage 30 is advanced into contact with the edge of the piece of material (not shown). The saw carriage and miter guide are then advanced toward the saw blade 14 so that the piece of material is crosscut. The rolling operation of rolling carrier 40** greatly reduces the friction associated with feeding the piece of lumber or material into the saw. This ease of operation allows the sawyer to work to closer tolerances and provide better and smoother saw cuts.

FIG. 5 shows an alternative embodiment of the invention which incorporates an adjustable linkage so that material can be crosscut at oblique angles with respect to the side of the material engaged by outer face 58. The linkage mechanism 60 includes a link 61 which is connected to the angle bracket 47 at one end and to the second leg 54 of transverse beam 50 at the opposite end. Wing fasteners 63 and 64 are preferably used for the connections between link 61 and transverse beam 50 and angle bracket 47. The wing fasteners 63 and 64 allow the angular orientation of the outer face 58 to be adjusted more easily.

The adjustable saw carriage shown in FIG. 5 is used by first determining the angular orientation which is desired for outer face 58. Transverse beam 50 is connected to miter guide head 18. The miter guide head adjustment nut 19 is released so that the miter guide head can be rotated with respect to the miter guide bar 17. Link 61 can then be attached between transverse beam 50 and angle bracket 47 using wing fasteners 63 and 64. Transverse beam 50 and miter head 18 can then be rotated into the desired angular position and secured in place using adjustment nut 19. A plurality of holes are provided in the second leg 54 of transverse beam 50 so that link 61 can be attached at different points if desired.

This adjustment procedure can be used to arrange the outer face 58 of transverse beam 50 in any angular orientation which can commonly be assumed by the miter guide head 18. Adjustment is simplified since only adjustment nut 19 need be tightened or released. Wing fasteners 63 and 64 need not be loosened for normal adjustment of the angular position. It will occasionally be necessary to remove link 61 from transverse beam 50 so that the miter guide 16 and transverse beam 50 can be positioned from the front to the back of the angle bracket 47. Link 61 can then be reattached as described above. A spacer (not shown) can be placed between link 61 and bracket 47 to compensate for the thickness of second leg 54 when it is swung into an angular position and is no longer sandwiched between link 61 and bracket 47.

The embodiments described above can be constructed of any suitable material as is well-known in the art. It is preferred that the components be constructed of metal such as steel or aluminum. The components of the invention are made according to well-known metal working techniques.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A crosscut saw carriage for use with a crosscut saw having a saw blade mounted in a saw table, and a miter guide slidable upon the saw table;

the miter guide having a pivotable miter guide head which can be pivoted with respect to the direction of travel of the miter guide upon the saw table, comprising:

a rail mounted at the side of the saw table and parallel with the direction of travel of the miter guide;

a rolling carriage having a plurality of rollers for rolling engagement upon the rail to allow the rolling carrier to translate along said rail;

a transverse beam extending across at least a portion of the saw table; the transverse beam being adapted for rigid connection to the pivotable miter guide head adjacent one end thereof;

an adjustable link connected to and extending between the rolling carrier and the transverse beam; the adjustable link being connected to the transverse beam and rolling carrier by fasteners which allow the angular orientation of the adjustable link and transverse beam to be adjusted for different angular orientations with respect to the saw table.

* * * * *